US010197244B2

(12) United States Patent
Quadri et al.

(10) Patent No.: US 10,197,244 B2
(45) Date of Patent: Feb. 5, 2019

(54) STAGE LIGHT FIXTURE

(71) Applicant: CLAY PAKY S.P.A., Seriate (IT)

(72) Inventors: Pasquale Quadri, Torre De'Roveri (IT); Angelo Cavenati, Brusaporto (IT)

(73) Assignee: CLAY PAKY S.P.A., Seriate (IT)

( * ) Notice: Subject to any disclaimer, the term of this patent is extended or adjusted under 35 U.S.C. 154(b) by 443 days.

(21) Appl. No.: 14/644,978

(22) Filed: Mar. 11, 2015

(65) Prior Publication Data

US 2015/0260372 A1 Sep. 17, 2015

(30) Foreign Application Priority Data

Mar. 12, 2014 (IT) ..... MI2014A0388

(51) Int. Cl.

| | |
|---|---|
| ***F21V 9/40*** | (2018.01) |
| ***F21V 7/00*** | (2006.01) |
| ***F21S 10/00*** | (2006.01) |
| ***F21V 5/04*** | (2006.01) |
| ***F21V 13/14*** | (2006.01) |
| ***F21V 29/15*** | (2015.01) |
| ***F21S 10/02*** | (2006.01) |
| *F21V 13/10* | (2006.01) |
| *F21V 5/00* | (2018.01) |
| *F21W 131/406* | (2006.01) |

(52) U.S. Cl.

CPC ..... *F21V 7/0066* (2013.01); *F21S 10/007* (2013.01); *F21S 10/026* (2013.01); *F21V 5/048* (2013.01); *F21V 9/40* (2018.02); *F21V 13/14* (2013.01); *F21V 29/15* (2015.01); *F21V 5/008* (2013.01); *F21W 2131/406* (2013.01)

(58) Field of Classification Search

CPC . F21V 9/10; F21V 29/15; F21V 5/048; F21V 7/0066; F21V 13/14; F21S 10/007; F21S 10/026

See application file for complete search history.

(56) References Cited

U.S. PATENT DOCUMENTS

| | | | | |
|---|---|---|---|---|
| 6,645,231 | B1 * | 11/2003 | Caldironi | A61N 5/0616 606/2 |
| 2013/0107166 | A1 * | 5/2013 | Osaka | G02F 1/133308 349/61 |
| 2014/0118991 | A1 * | 5/2014 | Lin | G02B 26/008 362/84 |

FOREIGN PATENT DOCUMENTS

| | | |
|---|---|---|
| CN | 1263589 | 8/2000 |
| CN | 102588764 | 7/2012 |
| EP | 0248974 | 12/1987 |
| EP | 2028517 | 2/2009 |
| EP | 2 722 581 | 4/2014 |
| GB | 2 316 477 | 2/1998 |

(Continued)

*Primary Examiner* — Anh Mai

*Assistant Examiner* — Nathaniel Lee

(74) *Attorney, Agent, or Firm* — Leason Ellis LLP

(57) ABSTRACT

Stage light fixture provided with:

a short arc lamp adapted to emit a light beam along an optical axis;

a reflector associated to the short arc lampso as to concentrate light beam rays substantially at a work point;

an output optical assembly, arranged at the most downstream point along the optical axis, having a focal point arranged between the light source and the output optical assembly and coinciding with the work point;

at least one color assembly comprising a plurality of color devices configured to selectively color the light beam; the color assembly being arranged between the short arc lampand the work point (PL).

18 Claims, 8 Drawing Sheets

(56) References Cited

FOREIGN PATENT DOCUMENTS

| | | | | | |
|---|---|---|---|---|---|
| GB | 2316477 | A | * | 2/1998 | ..... F21S 10/007 |
| GB | 2 483 554 | | | 3/2012 | |
| GB | 2483554 | A | * | 3/2012 | ..... F21S 10/007 |
| WO | WO 2007/122459 | | | 11/2007 | |
| WO | WO 2007122459 | A2 | * | 11/2007 | ..... F21V 5/008 |

* cited by examiner

STAGE LIGHT FIXTURE

CROSS-REFERENCE TO RELATED APPLICATION

The present claims priority under 35 U.S.C. 119 to Italian Patent Application No. MI2014A000388, filed Mar. 12, 2014, which is hereby incorporated by reference in its entirety.

The present invention relates to a stage light fixture.

BACKGROUND OF THE INVENTION

In recent years, in the field of stage light fixtures, the need to reduce the space taken up and the masses of light fixtures themselves has arisen, so as to make it easier and faster for operators to move such light fixtures in a controlled manner.

As a consequence, the space available to house the components of stage light fixtures has been reduced to a minimum.

In particular, in stage light fixtures of the type described by the applicant in patent application MI2010A001614, the available spaces are particularly small. These stage light fixtures are characterized by a short arc lamp coupled to a reflector able to concentrate a light beam at a work point coinciding with the focal point of the output optical assembly of the stage light fixture.

This structure allows operators to obtain a light beam that is compact, narrow, aligned, well-defined and has a very high concentration, so as to define a "light bar". However, in these stage light fixtures, the available spaces, due to the close relationship among the light source, the focus and the optical group, are very small and there are numerous technical difficulties in providing a stage light fixture that, besides creating the so-called "light bar", also allows operators to obtain a wide range of effects aimed at characterizing the light bar.

SUMMARY OF THE INVENTION

Therefore, the object of the present invention is to provide a stage light fixture of the type described above, which is able to generate a high-efficiency light beam and to process the light beam so as to obtain desired stage effects.

In accordance with this object, the present invention relates to a stage light fixture comprising:

- a short arc lamp adapted to emit a light beam along an optical axis;
- a reflector associated to the short arc lamp so as to concentrate light beam rays substantially at a work point;
- an output optical assembly, arranged at the most downstream point along the optical axis, having a focal point arranged between the light source and the output optical assembly and coinciding with the work point;
- at least one color assembly comprising a plurality of color devices configured to selectively color the light beam; the color assembly being arranged between the short arc lamp and the work point.

Thanks to the presence of at least two color devices arranged between the short arc lamp and the work point and thanks to the combination of the two color devices properly arranged in the area of the optical axis, one can obtain a plurality of stage effects.

The positioning of the color devices between the short arc lamp and the work point is particularly advantageous, since the light beam generated by the stage light fixture has no defects. As a matter of fact, the positioning of the color devices downstream of the work point determines a worsening of the quality features of the light beam and, furthermore, reduces the space available to house further elements able to generate stage effects. Basically, thanks to the arrangement of the color assembly described above, one can obtain a stage light fixture that is able to generate a high-efficiency and high-quality light beam and, at the same time, to process the light beam so as to obtain the desired stage effects.

According to a preferred embodiment of the present invention, each color device comprises a disc. In this way, the color devices can be placed, moved and manufactured in an easier fashion.

According to a preferred embodiment of the present invention, the color devices are parallel to one another. In this way, the color devices can be moved in an easier fashion and, furthermore, the space take up by the color assembly is minimized.

According to a preferred embodiment of the present invention, at least one color device is transversal to the optical axis so as to form an angle with a plane perpendicular to the optical axis. In this way, the hot rays reflected by the color devices hit the heat-shield filter at a given angle, said heat-shield filter being preferably inclined so as to reflect said hot rays outwards and avoid the overheating of the short arc lamp.

Furthermore, the inclination of the color devices permits an optimization of the spaces between the short arc lamp and the work point, thus also enabling the insertion of further color devices.

According to a preferred embodiment of the present invention, the color devices are rotatable about a same rotational axis. In this way, the color devices can be moved without the need for large free spaces for the handling thereof and, furthermore, one can obtain multiple optical effects.

According to a preferred embodiment of the present invention, the color devices are independently moved. In this way, one can adjust the relative position between one color device and another, so as to obtain further optical effects on the light beam.

According to a preferred embodiment of the present invention, the rotational axis is inclined with respect to the optical axis of an angle, preferably comprised between 6° and 10°, for example 8°.

In this way, the color devices are arranged in such a way that the hot rays reflected by the color device hit the heat-shield filter at a given angle, said heat-shield filter being preferably inclined so as to reflect said hot rays outwards and avoid the overheating of the short arc lamp. Furthermore, the inclination of the color devices permits an optimization of the spaces between the short arc lamp and the work point, thus also enabling the insertion of further color devices.

According to a preferred embodiment of the present invention, the color assembly is arranged so that, in use, at least one portion of each color device of the plurality of color devices intersects the optical axis. In this way, all the color devices take part in the processing of the light beam.

According to a preferred embodiment of the present invention, each color device of the plurality of color devices comprises at least one first filter and at least one second filter; the first filter being a color filter configured to transmit light radiation having wavelengths comprised in at least one first respective band.

In this way, a single color device integrates at least one first color filter and one second filter, for example of a different kind. In this way, in each color device many effects are integrated (at least one color effect and at least one other effect). As the light fixture comprises more than one color device, different filters can be aligned along the optical axis in order to obtain a plurality of combination of filters superimposition in order to obtain new and surprising light and color effects on the stage.

Advantageously, the presence of a single color device integrating at least one first color filter and one second filter avoids the use of a further beam processing element arranged on the outside of the color assembly and, therefore, enables an optimization of the available spaces.

According to a preferred embodiment of the present invention, the first filter is configured to create a progressive change of color in the beam passing through it during the rotation of the respective color device.

In this way, one can obtain a fading effect on the light beam by passing from a lighter color shade to a darker color shade and vice versa; this is done by simply moving the respective color device. Moreover, the presence of a fading effect integrated in the color device avoids the use of the usually adopted further fading processing element arranged on the outside of the color assembly. In this way the optimization of the available spaces of the stage light fixture is noticeably improved.

According to a preferred embodiment of the present invention, the first filter is at least a portion of an annular filter. In the prior art solutions, the fading effect is obtained by an entire annular filter. Thanks to this preferred embodiment, the fading effect is obtained by a portion of an annular filter. This solution leaves space available for other first or second filters.

According to a preferred embodiment of the present invention, the color device comprises a plurality of first filters arranged in succession along an annular path and configured to transmit respective light radiations so as to create a progressive change of color in the beam passing through them during the rotation of the respective color device. In this way the fading effect is obtained by a plurality of first filters instead of a single first filter.

According to a preferred embodiment of the present invention, the second filter is a hot filter, configured to reduce the color temperature of the passing-through light beam. The presence of a hot filter in at least one color device gives users the possibility to combine the effect of any filter of the color devices with at least one hot filter, so as to obtain a particular coloring that, up to now, could not be obtained with stage light fixtures of this type. Advantageously, the presence of a hot filter avoids the need of a further beam processing element arranged outside the color assembly and, therefore, enables an optimization of the available spaces.

According to a preferred embodiment of the present invention, the second filter is a cold filter configured to increase the color temperature of the passing-through light beam. In this way, one can combine the effect of any filter of the color devices with at least one cold filter so as to obtain further optical effects.

According to a preferred embodiment of the invention the second filter is a diffusing filter, configured to diffuse the passing-through light beam. In this way, the diffusing filter helps decrease the intensity of the light beams lowering its temperature and reducing the risk of inflammability for objects lit by the light fixture. This risk is particularly high when the lit object is arranged at a distance that is smaller than 18 m.

According to a preferred embodiment of the present invention, the second filter is one Wood filter.

According to a preferred embodiment of the invention the second filter is a color filter configured to color the passing-through light beam.

As a matter of fact, the hot light filter, the cold light filter, the wood filter, the diffusing element are usually carried out by further respective processing elements arranged outside the color assembly and adjusted in an autonomous manner (for example gelatines arranged on the outside of the stage light fixture, or devices that are especially dedicated to the modification of color temperature, etc.).

The integration of all these effects in the color assembly has the advantage of reducing the space taken up and the masses of light fixtures themselves and at the same time obtaining a plurality of lighting effects.

According to a preferred embodiment of the present invention, the stage light fixture comprises a heat-shield filter that is transversal to the optical axis so as to form an angle with a plane perpendicular to the optical axis. In this way, the hot rays reflected by the light beam processing elements arranged downstream of the heat-shield filter are bounced back by the heat-shield filter and led towards the casing of the light fixture, whereas the hot rays generated by the light source are reflected on the inner surface of the reflector, which is properly treated.

According to a preferred embodiment of the present invention, the heat-shield filter is arranged along a plane which intersects the plane comprising at least one color device of the plurality of color devices, so as to form an angle, preferably comprised between 12° e 20°, preferably 16°.

In this way, the rays reflected by the color devices are bounced back by the heat-shield filter and led towards the casing, thus avoiding the overheating of the light source.

According to a preferred embodiment of the present invention, the stage light fixture comprises at least one gobos device arranged at the work point. In this way, the gobos device exploits the maximum concentration of the light beam.

BRIEF DESCRIPTION OF THE DRAWINGS

Further features and advantages of the invention will be best understood upon perusal of the following description of a non-limiting embodiment thereof, with reference to the accompanying drawing, wherein.

DETAILED DESCRIPTION OF THE INVENTION

Figure 1:
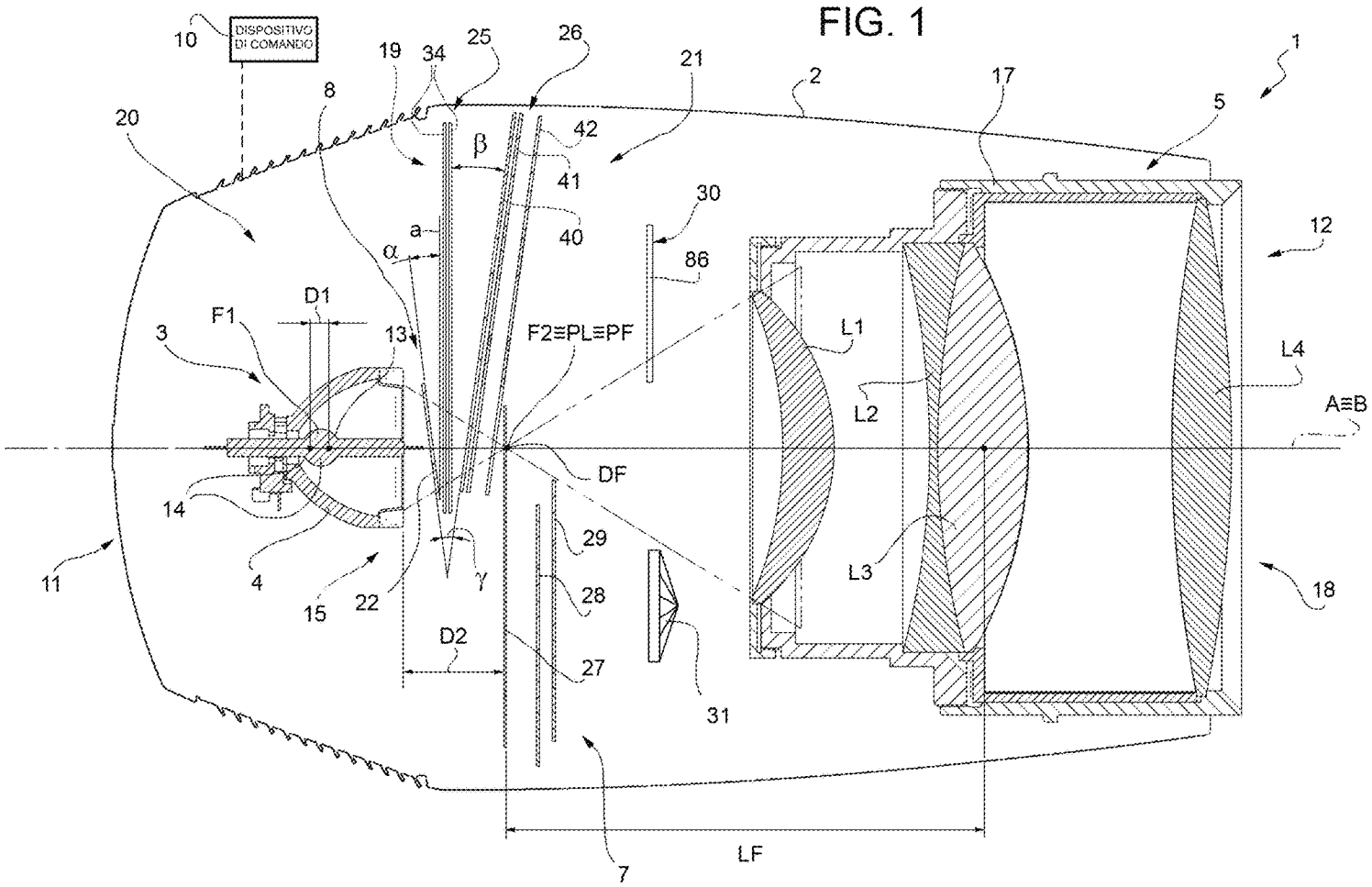
FIG. 1 is a schematic view from above, with cross-sectional parts and parts removed for greater clarity, of a stage light fixture according to the present invention.

FIG. 1 shows, with reference number 1, a stage light fixture comprising a casing 2, a light source 3, a reflector 4, an optical assembly 5, a light beam processing device 7 (schematically shown in FIG. 1), a heat-shield assembly 8 (schematically shown in FIG. 1), and a control device 10.

The casing 2 extends along a longitudinal axis A and has a closed end 11 and an open end 12, which is opposite to the closed end 11 along the axis A. Preferably, the casing 2 is supported by support means (not shown in the accompanying figures for greater clarity). In particular, the support means and the casing 2 are configured to allow the casing 2 to rotate about two orthogonal axes, commonly known as PAN and TILT axes.

Preferably, the stage light fixture 1 comprises a skeleton (not shown in the accompanying figures for greater clarity), which is made up of elements that are coupled to one another and configured to define a support structure for the elements arranged on the inside of the casing 2, such as the light source 3, the reflector 4, the light beam processing device 7, and the heat-shield assembly 8.

The light source 3 is arranged on the inside of casing 2 in the area of the closed end 11 of the casing 2, is supported by the skeleton, and is adapted to emit a light beam substantially along an optical axis B.

In the non-limiting embodiment described and discussed herein, the optical axis B coincides with the longitudinal axis A of the casing 2.

The light source 3 is a short arc lamp.

In particular, the short arc lamp 3 comprises a bulb 13, which is generally made of glass or quartz and contains halides.

On the inside of the bulb 13 there are arranged two electrodes 14, which are connected to a power supply circuit (not shown in the accompanying figures) and are arranged at a distance D1 from one another.

The distance D1 between the electrodes 14 is approximately smaller than 2 mm. In the non-limiting embodiment described and discussed herein, the distance D1 is approximately 1.3 mm.

In the non-limiting embodiment described and discussed herein, the short arc lamp 3 has a power that is approximately greater than 450 Watts, preferably greater than 480 Watts.

The reflector preferably is an elliptical reflector, is coupled to the light source 3, and is provided with an outer edge 15.

In particular, the reflector 4 is coupled to the light source 3 so as to concentrate light beam rays substantially at a work point PL that is arranged at a distance D2 from the outer edge 15 of the reflector 4.

In particular, as the reflector 4 is elliptical, it is provided with two focuses F1 and F2. Preferably, the light source 3 is arranged in a first focus Fl of the elliptical reflector 4, so that the rays emitted by the light source are reflected and concentrated at the second focus F2 of the reflector 4. The second focus F2 defines the work point PL, which is arranged at the distance D2 from the outer edge 15 of the reflector 4.

In the non-limiting embodiment described and discussed herein, the distance D2 is approximately equal to 36 mm.

The light beam reflected by the reflector 4 and concentrated at the work point PL is substantially punctiform and has a diameter DF that can reach, at the most, 1 mm.

Preferably, in the work point PL the light beam has a diameter DF measuring 0.8 mm.

Basically, the rays of the light beam generate, in the work point PL, a highly concentrated and substantially punctiform light beam.

The optical assembly 5 is arranged in the area of the open end 12 of the casing 2, so as to be centred on the optical axis B and close the casing 2.

The optical assembly 5 in an output optical assembly, arranged at the most downstream point along the optical axis B, so as to be the last assembly adapted to process the light beam intercepted.

The optical assembly 5 has a focal point PF arranged between the light source 3 and the optical assembly 5.

Preferably, the focal point PF coincides with the work point PL. In this way, the optical assembly 5 can capture and focus the light beam concentrated at the work point PL. Therefore, the light beam coming out of the optical assembly 5 will be very intense and concentrated.

The optical assembly 5 is characterized by a focal length LF, which is able to substantially reduce to zero the DF/LF ratio. Wherein DF is the diameter of the light beam concentrated and reflected at the focal point PF and LF is the focal length (also called focal distance or, more simply, focal) of the optical assembly 5 and is defined by the distance in mm between the centre of the optical assembly 5 (also known as nodal point) and the focal point PF of the optical assembly.

In this way, the output angle of the light beam emitted by the stage light fixture 1 will have radii that are substantially parallel or, at the most, have a minimum deflection angle.

For example, in the non-limiting embodiment described and discussed herein, in which the diameter of the lenses of the optical assembly 5 is equal to 170 mm, the focal length LF measures 170 mm and the diameter of the light beam concentrated and reflected at the focal point PF is 0.8 mm, we have a beam deflection angle, at a projection distance of 100 meters, that is approximately equal to 0.2°.

The optical assembly 5 has a positive refractive power and is mobile along the optical axis B so as to adjust the focusing of the projected image.

Preferably, the optical assembly 5 is mobile along the optical axis B between a first operating position and a second operating position.

In the non-limiting embodiment described and discussed herein, the optical assembly 5 comprises a support frame 17 and a plurality of lenses 18, which are supported by the support frame 17.

According to a variant of the present invention, the optical assembly comprises one single lens supported by a respective frame.

Preferably, the support frame 17 is coupled to a carriage (not shown for greater clarity), which is mobile along the optical axis B and whose movement is adjusted by an autofocus device (known and not shown).

In the non-limiting embodiment described and discussed herein, the optical assembly 5 preferably comprises a convex-concave lens L1, a biconcave lens L2, a biconvex lens L3 and a biconvex lens L4. Lenses L1 and L2 are spaced apart from one another. Lenses L2 and L3 are coupled to one another, whereas lens L4 is spaced apart from lens L3.

The heat-shield assembly 8 is substantially configured so as to generate a thermal barrier between an area 20, in which the light source 3 is housed, and an area 21, in which the light beam processing device 7 are housed.

The heat-shield assembly 8 comprises a heat-shield filter 22 and a frame (not shown in the accompanying drawings), which is coupled to the skeleton and is configured to support the heat-shield filter 22.

The heat-shield filter 22 is configured to filter hot radiations (radiations that cause a temperature increase of the body hit by them) in the range of non-visible radiations coming from the area 20 where the light source 3 is arranged. In this way, the hot radiations in the range of non-visible radiations generated by the light source 3 and by the reflector 4 are prevented from hitting the light beam processing device 7.

Preferably, the heat-shield filter 22 is transversal to the optical axis B. In the non-limiting embodiment described and discussed herein, the heat-shield filter 22 forms an angle $\alpha$ with a plane a perpendicular to the optical axis B. The angle $\alpha$ is a dihedral angle preferably comprised between 6° and 10°. In the non-limiting embodiment described and discussed herein, the angle $\alpha$ measures 8°. In other words, the heat-shield filter 22 is inclined at an angle of 82° relative to the optical axis B.

In this way, the hot rays reflected by the light beam processing elements 7 arranged downstream of the heat-shield filter 22 are bounced back by the heat-shield filter 22 and led towards the casing 2 of the light fixture 1, whereas the hot rays generated by the light source 3 are reflected on the inner surface of the reflector 4, which is properly treated in order to increase heat dispersion. The heat generated by the hot rays led towards the casing 2 is dispersed by a ventilation system that is not shown herein.

Therefore, the inclination of the heat-shield filter 22 avoids the overheating of the light source 3.

The light beam processing device 7 are supported by the skeleton and are configured to process the light beam generated by the light source 3, so as to obtain special effects.

In particular, the light beam processing device 7 comprise, preferably in sequence, at least one dimmer 25, a color assembly 26, a first gobos device 27, a rainbow device 28, a second gobos device 29, a frost assembly 30, and a prismatic element 31.

Obviously, the light beam processing device 7 can comprise further light beam processing devices that are not explicitly described herein.

Preferably, the first gobos device 27 is arranged in the area of the work point PL, whereas the rainbow device 28, the second gobos device 29, the frost assembly 30 and the prismatic element 31 are arranged between the work point PL and the optical assembly 5.

Figure 2:
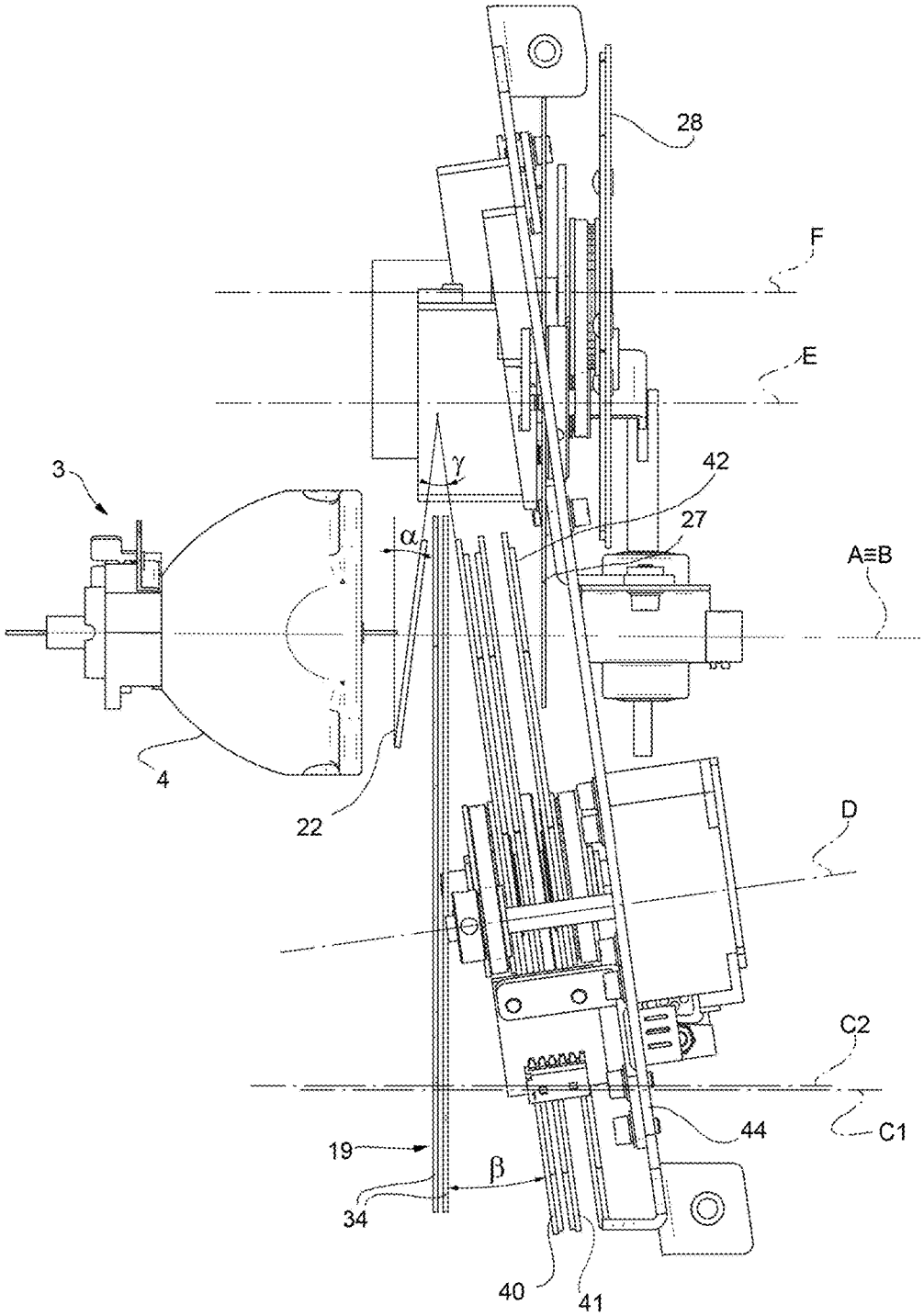
FIG. 2 is a cross-sectional view from the bottom, with parts removed for greater clarity, of a first detail of the stage light fixture of FIG. 1.

With reference to FIG. 2, the dimmer 19 comprises two mobile plates 34, which are arranged along two planes that are substantially orthogonal to the optical axis B. The plates 34 are opaque to visible radiations. When they intercept the light beam, the plates 34 determine a reduction of the luminosity of the light beam.

In particular, the plates 34 are respectively provided with an end that is hinged to a support plate (not visible in FIG. 2) and can rotate around a respective axis C1, C2.

Preferably, the plates 34 are moved independently of one another by a respective motor (not visible in the accompanying drawings).

The rotation axes C1, C2 are substantially parallel to the optical axis B, but they do not coincide with the optical axis B.

The color assembly 26 comprises at least one first color device 40, which is preferably transversal to the optical axis B so as to form an angle $\beta$ with a plane b perpendicular to the optical axis B. The angle $\beta$ is a dihedral angle preferably comprised between 6° and 10°. In the non-limiting embodiment described and discussed herein, the angle $\beta$ measures 8°. In other words, the color device 40 is inclined at an angle of 82° relative to the optical axis B. In the non-limiting embodiment described and discussed herein, the color assembly 26 also comprises a second color device 41 and a third color device 42. The first color device 40, the second color device 41 and the third color device 42 are defined by discs that are parallel to one another.

The first color device 40, the second color device 41 and the third color device 42 are rotatable about a same rotational axis D, which is not parallel to the optical axis B and coincides neither with the optical axis B nor with the rotational axis C of the dimmer 19.

In particular, the rotational axis D is inclined with respect to the optical axis B by approximately 8°.

According to a further embodiment not illustrated, the color devices 40, 41, 42 are arranged orthogonal to the optical axis.

The first color device 40, the second color device 41 and the third color device 42 are arranged in succession along the rotational axis D and are moved independently of one another. The adjustment of the relative position among the first color device 40, the second color device 41 and the third color device 42 is carried out by the control device 10 (FIG. 1).

The first color device 40, the second color device 41 and the third color device 42 are supported by a support plate 44, ad described more in detail below, so that at least a portion of the first color device 40, a portion of the second color device 41 and a portion of the third color device 42 always intercept the light beam emitted by the light source 3. In other words, the first color device 40, the second color device 41 and the third color device 42 are arranged so as to at least partially intersect the optical axis B.

Figure 3:
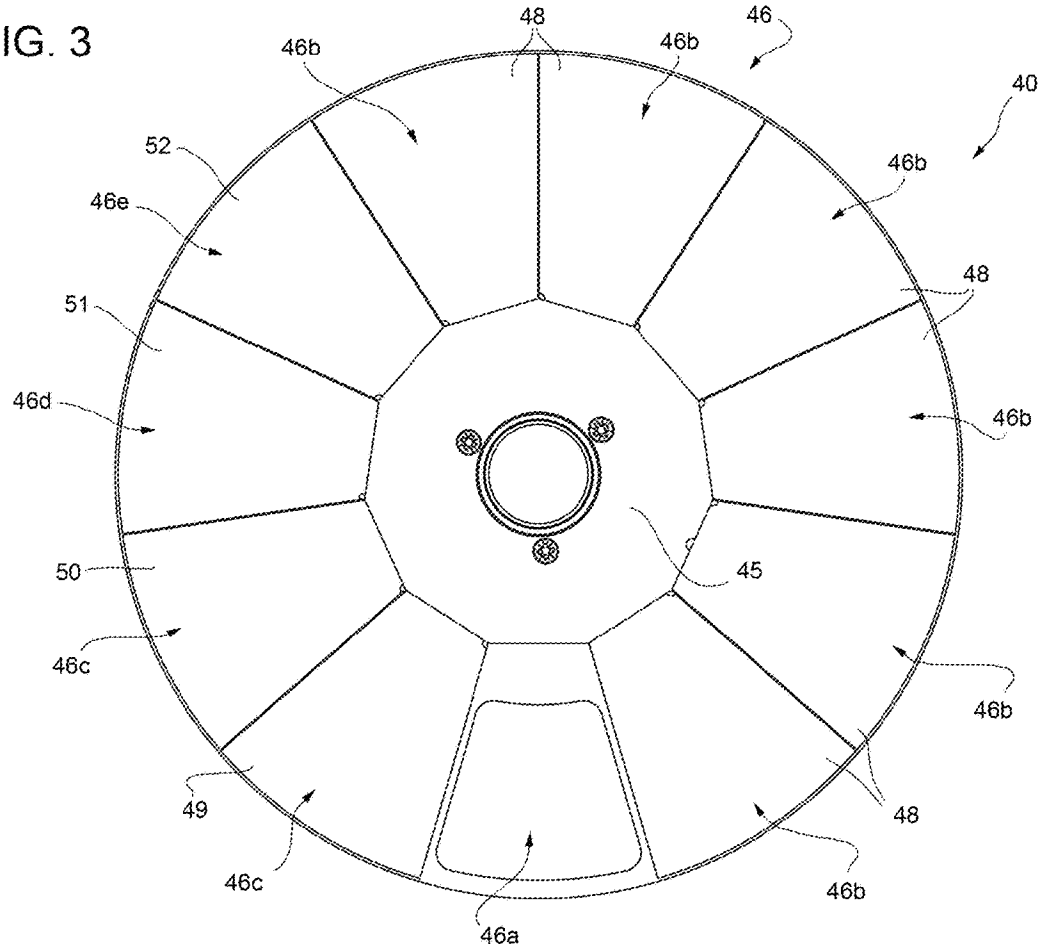
FIG. 3 is a front view, with parts removed for greater clarity, of a second detail of the stage light fixture of FIG. 1.

With reference to FIG. 3, the first color device 40, arranged close to the light source 3, is defined by a plate 45, preferably made of metal, which is provided with a plurality of trapezoidal sectors 46, which are substantially arranged one beside the other along a peripheral ring of the plate 45. In the non-limiting embodiment described and discussed herein, the trapezoidal sectors 46 of the first color device 40 are eleven.

The trapezoidal sectors 46, except one, are coupled to respective light beam processing elements, preferably filters.

In detail, the first color device 40 is supported by the support plate 44 so that the trapezoidal sectors 46 intercept the light beam and intersect the optical axis B during the rotation about the rotational axis D of the first color device 40.

In this way, the light beam emitted by the light source 3 passes through a respective trapezoidal sector 46 and is selectively processed in accordance with the properties of the light beam processing elements coupled to the trapezoidal sector 46 intersecting the light beam itself.

In the non-limiting embodiment described and discussed herein, the plurality of trapezoidal sectors 46 comprise: a trapezoidal sector 46*a*, which is not associated with any filter and does not determine any variation of the light beam passing through it; a plurality of trapezoidal sectors 46*b*, which are arranged in a consecutive fashion and are coupled to respective cyan color filters 48; two trapezoidal sectors 46*c*, which are coupled to a diffusing filter 49 and to a first hot filter 50, respectively; a trapezoidal sector 46*d*, which is coupled to a respective first cold filter 51; and, finally, a trapezoidal sector 46*e*, which is coupled to a Wood filter 52.

In the non-limiting embodiment described and discussed herein, the cyan color filters 48 are six and they are made of a material comprising a glass substrate, on which a succession of dielectric material layers are deposited.

Each cyan color filter 48 is configured to transmit light radiations having wavelengths comprised in one respective transmission band. The transmission band is defined by a lower cut-off wavelength and by an upper cut-off wavelength. The upper cut-off wavelength of the cyan color filters 48 ranges from 515 to 585 nm.

The transmission bands of consecutive cyan color filters 48 have an increasing upper cut-off wavelength. In this way, the consecutive cyan color filters 48 are configured to transmit light radiations so as to create a progression of a color.

Thanks to this feature, during the rotation of the first color device 40 about its own rotational axis D, one can gradually change the coloring of the projected light beam from a lighter cyan to a darker cyan or vice versa according to the direction of rotation of the first color device 40.

The first hot filter 50 is configured to reduce the color temperature of the light beam passing through it. For example, the hot filter 50 is configured to transmit wavelengths that simulate the effect that would be obtained with a filament lamp.

The diffusing filter 49 is configured to diffuse the light beam passing through it, in order to reduce the intensity of the light beam coming out of the stage light fixture 1.

The cold filter 51 is configured to increase the color temperature of the light beam passing through it.

The Wood filter 52 is configured to transmit light radiations between 320 and 400 nm with a peak at 365 nm and is opaque to all visible light except for red and violet.

Figure 4:
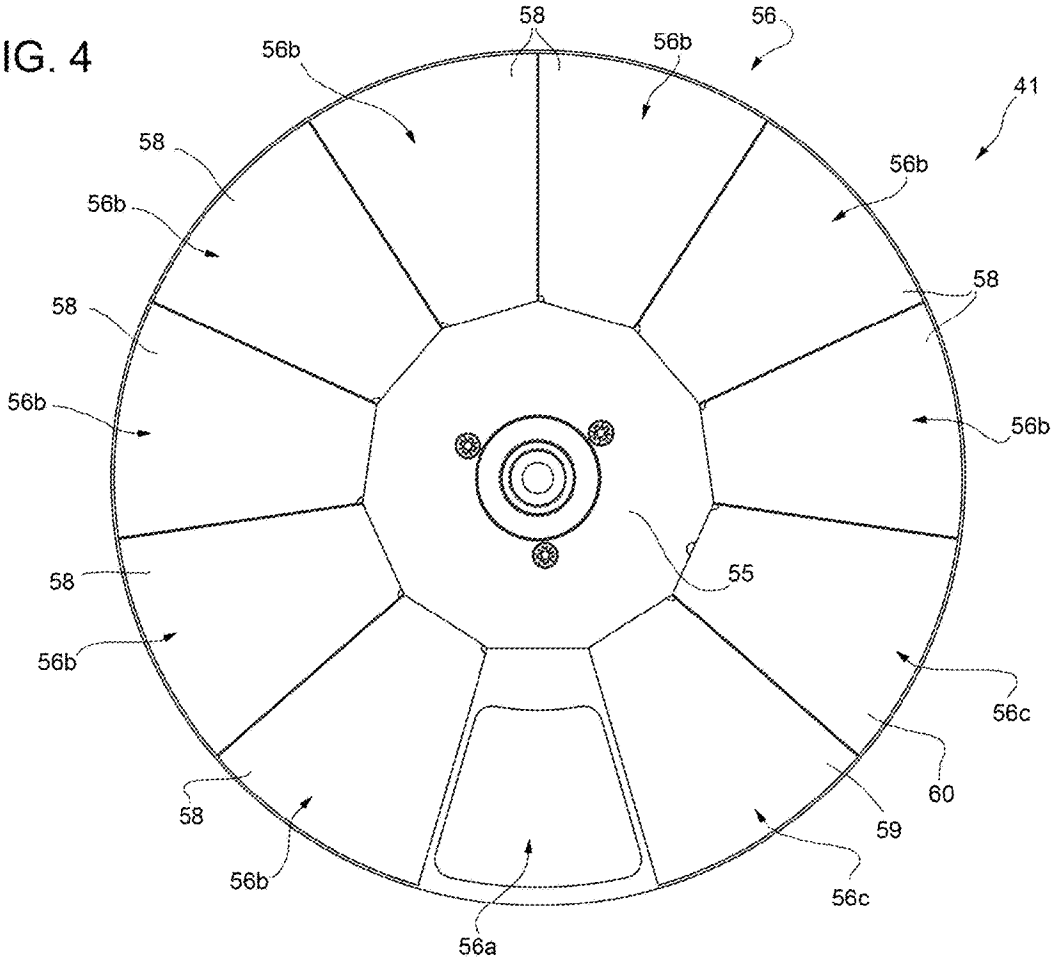
FIG. 4 is a front view, with parts removed for greater clarity, of a third detail of the stage light fixture of FIG. 1.

With reference to FIG. 4, the second color device 41 is arranged between the first color device 40 and the third color device 42 and is defined by a plate 55, preferably made of metal, which is provided with a plurality of trapezoidal sectors 56, which are substantially arranged one beside the other along a peripheral ring of the plate 55. In the non-limiting embodiment described and discussed herein, the trapezoidal sectors 56 of the second color device 41 are eleven.

The trapezoidal sectors 56, except one, are coupled to respective light beam processing elements.

In detail, the second color device 41 is supported by the support plate 44 so that the trapezoidal sectors 56 intercept the light beam and intersect the optical axis B during the rotation about the rotational axis D of the second color device 41.

In this way, the light beam emitted by the light source 3 passes through a respective trapezoidal sector 56 and is selectively processed in accordance with the properties of the light beam processing elements coupled to the trapezoidal sector 56 intersecting the light beam itself.

In the non-limiting embodiment described and discussed herein, the plurality of trapezoidal sectors 56 comprise: a trapezoidal sector 56*a*, which is not associated with any filter and does not determine any variation of the light beam passing through it; a plurality of trapezoidal sectors 56*b*, which are arranged in a consecutive manner and are coupled to respective magenta color filters 58; and two trapezoidal sectors 56*c*, which are coupled to a first hot filter 59 and to a second hot filter 60, respectively.

In the non-limiting embodiment described and discussed herein, the magenta color filters 58 are eight and they are made of a material comprising a glass substrate, on which a succession of dielectric material layers are deposited.

Each magenta color filter 58 is configured to transmit light radiations having wavelengths comprised in two transmission bands. The first transmission band is defined by a first lower cut-off wavelength and by a first upper cut-off wavelength, whereas the second transmission band is defined by a second lower cut-off wavelength and by a second upper cut-off wavelength. The first upper cut-off wavelength of the magenta color filters 58 ranges from 445 to 468 nm, the second lower cut-off wavelength ranges from 540 to 645 nm.

The first transmission bands of consecutive magenta color filters 58 have an increasing first upper cut-off wavelength, whereas the second transmission bands of consecutive magenta color filters 58 have an increasing second lower cut-off wavelength.

In this way, the consecutive magenta color filters 58 are configured to transmit light radiations so as to create a progression of a color.

Thanks to this feature, during the rotation of the second color device 41 about its own rotational axis D, one can gradually change the coloring of the projected light beam from a lighter magenta to a darker magenta or vice versa according to the direction of rotation of the second color device 41.

The first hot filter 59 is configured to reduce the color temperature of the light beam passing through it.

The second hot filter 60 is configured to reduce the color temperature of the light beam passing through it.

Figure 5:
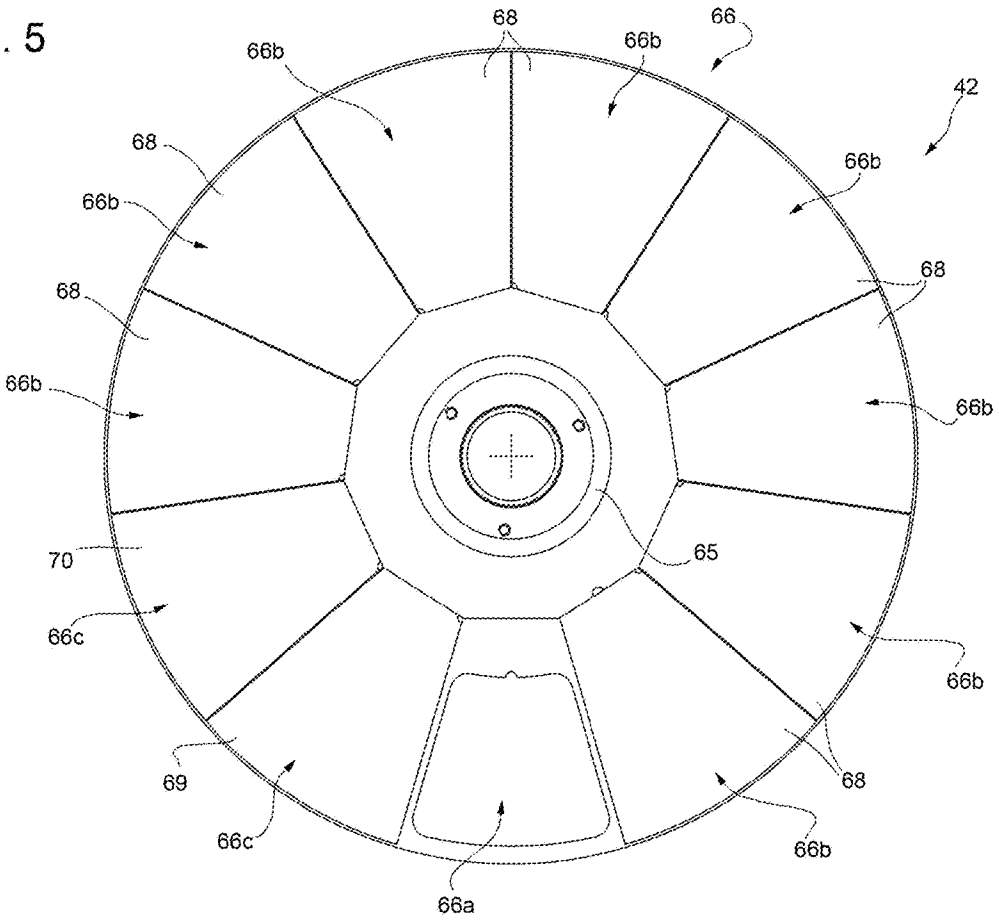
FIG. 5 is a front view, with parts removed for greater clarity, of a fourth detail of the stage light fixture of FIG. 1.

With reference to FIG. 5, the third color device 42 is arranged downstream of the second color device 41 close to the first gobos device 27 and is defined by a plate 65, preferably made of metal, which is provided with a plurality of trapezoidal sectors 66, which are substantially arranged one beside the other along a peripheral ring of the plate 65. In the non-limiting embodiment described and discussed herein, the trapezoidal sectors 66 of the third color device 42 are eleven.

The trapezoidal sectors 66, except one, are coupled to respective light beam processing elements.

In detail, the third color device 42 is supported by the support plate 44 so that the trapezoidal sectors 66 intercept the light beam and intersect the optical axis B during the rotation about the rotational axis D of the third color device 42.

In this way, the light beam emitted by the light source 3 passes through a respective trapezoidal sector 66 and is selectively processed in accordance with the properties of the light beam processing elements coupled to the trapezoidal sector 66 intersecting the light beam itself.

In the non-limiting embodiment described and discussed herein, the plurality of trapezoidal sectors 66 comprise: a trapezoidal sector 66*a*, which is not associated with any filter and does not determine any variation of the light beam passing through it; a plurality of trapezoidal sectors 66*b*, which are arranged in a consecutive manner and are coupled to respective yellow color filters 68; and two trapezoidal sectors 66*c*, which are coupled to a first hot filter 69 and to a second hot filter 70, respectively.

In the non-limiting embodiment described and discussed herein, the yellow color filters 68 are eight and they are made of a material comprising a glass substrate, on which a succession of dielectric material layers are deposited.

Each yellow color filter 68 is configured to transmit light radiations having wavelengths comprised in one respective transmission band. The transmission band is defined by a lower cut-off wavelength and by an upper cut-off wavelength. The lower cut-off wavelength of the yellow color filters 68 ranges from 490 to 620 nm.

The transmission bands of consecutive yellow color filters 68 have an increasing lower cut-off wavelength. In this way, the consecutive yellow color filters 68 are configured to transmit light radiations so as to create a progression of a color.

Thanks to this feature, during the rotation of the third color device 42 about its own rotational axis D, one can gradually change the coloring of the projected light beam from a lighter yellow to a darker yellow or vice versa according to the direction of rotation of the third color device 42.

The first hot filter 69 is configured to reduce the color temperature of the light beam passing through it.

The second hot filter 70 is configured to reduce the color temperature of the light beam passing through it.

Figure 6:
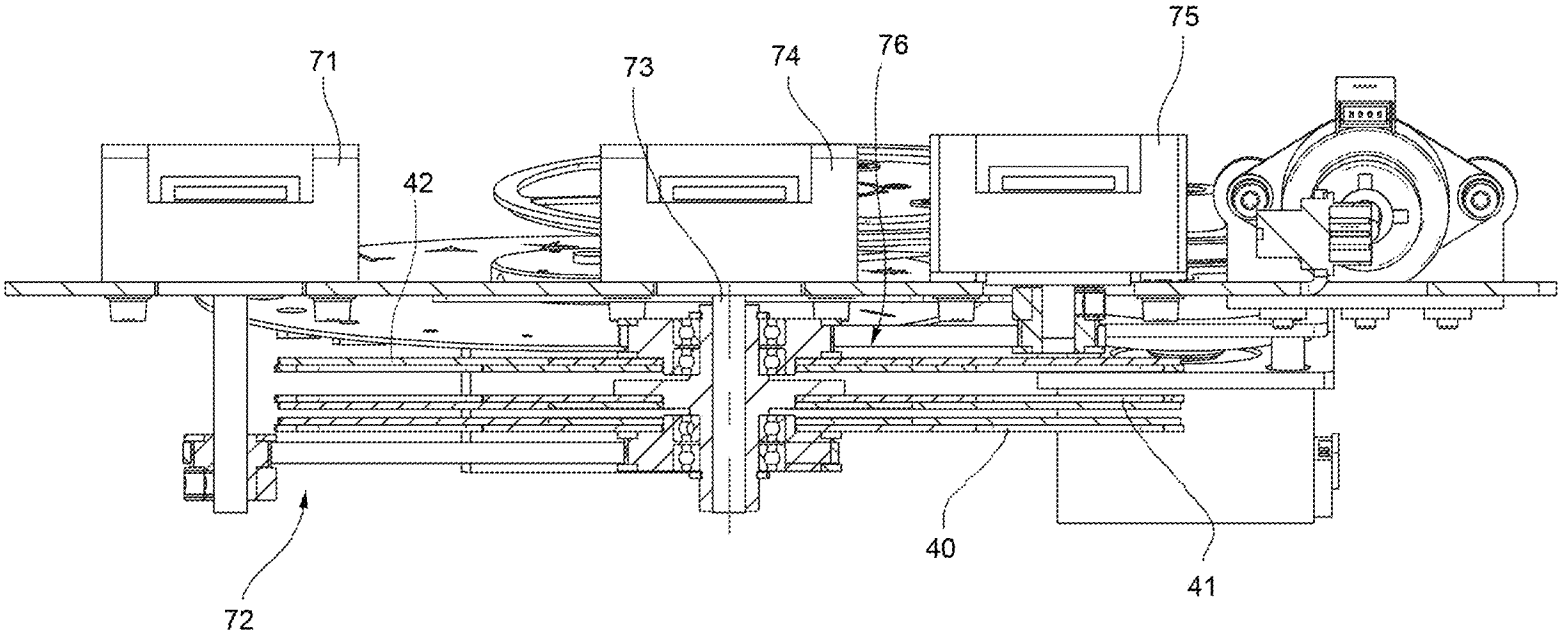
FIG. 6 is a cross-sectional view from above, with parts removed for greater clarity, of a fifth detail of the stage light fixture of FIG. 1.

With reference to FIG. 6, the first color device 40 is coupled to a respective motor 71 by a belt connection system 72.

The second color device 41 is coupled to a shaft 73, which is driven by a respective motor 74.

The third color device 42 is coupled to a respective motor 75 by a belt connection system 76.

The use of belt driving systems 72 and 76 ensures that the axial space taken up by the color assembly 26 is reduced.

In use, the controlled and independent rotation about the rotational axis D of the first color device 40, of the second color device 41 and of the third color device 42 determines the coloring of the light beam. In this way, one can obtain numerous shades of color of the light beam.

The only case in which the color assembly 26 does not determine a variation of the coloring of the beam occurs when the first color device 40, the second color device 41 and the third color device 42 are arranged in such a way the the beam intercepts the trapezoidal sectors 46*a*, 56*a* and 66*a*.

Figure 7:
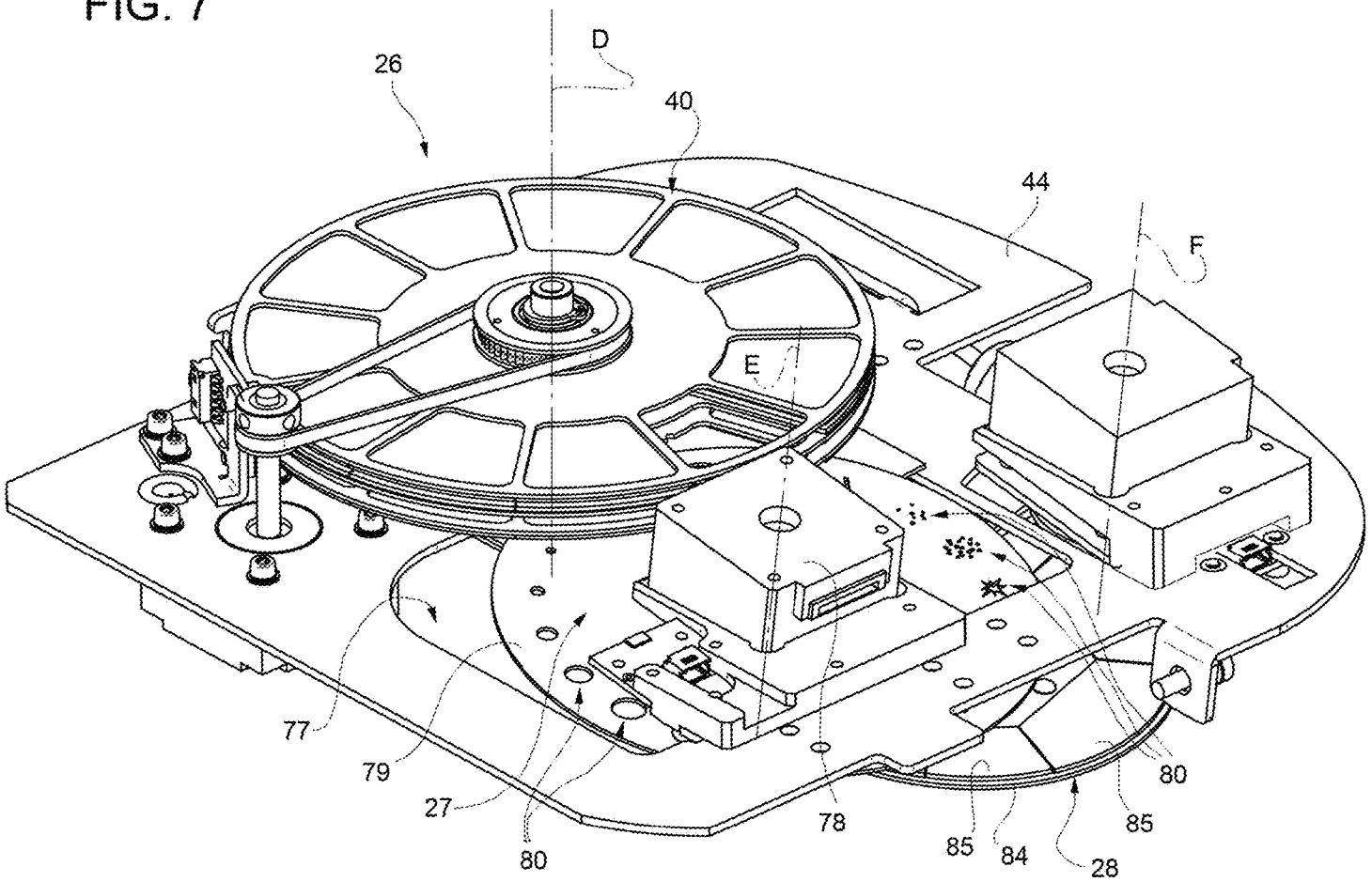
FIG. 7 is a perspective view, with parts removed for greater clarity, of a sixth detail of the stage light fixture of FIG. 1.

This configuration is shown in FIG. 7.

FIG. 7 clearly shows the support plate 44, which supports the color assembly 26, the first gobos device 27 and the rainbow device 28.

The support plate 44 is coupled to the skeleton of the casing 2 and is preferably fixed. The support plate 44 is provided with a main opening 77, through which the optical axis B of the light beam passes. The main opening 77 is large enough not to determine modifications of the light beam generated by the light source 3.

In particular, the first gobos device 27 is supported by the support plate 44 in such a way that the first gobos device 27 is substantially orthogonal to the optical axis B. The first gobos device 27 can rotate about a respective rotation axis E thanks to the coupling to a motor 78. Preferably, the rotation of the first gobos device 27 is driven by the control device 10 (FIG. 1).

In detail, the first gobos device 27 is defined by a plate 79, preferably made of metal or glass, on which there are obtained or drawn patterns or shapes 80, which are adapted to generate a given light design when the first gobos device 27 intercepts the light beam. Preferably, the patterns and/or the shapes 80 are obtained along an annular peripheral edge of the metal plate 79.

The rainbow device 28 is supported by the support plate 44 in such a way that the rainbow device 28 is substantially orthogonal to the optical axis B. The rainbow device 28 can rotate about a respective rotation axis F thanks to the coupling to a motor 82 by a respective belt driving system 83 (not clearly shown in the accompanying drawings). The rotational speed of the rainbow device 28 is capable of being modulated and it can be modulated also based on the moving speed of the casing 2.

Preferably, the rotation of the rainbow device 28 is governed by the control device 10.

In detail, the rainbow device 28 is defined by a plate 84, which is coupled to a plurality of coloured filters 85, which are arranged along an annular peripheral edge of the metal plate 84 (the filters are not completely visible in the accompanying drawings).

In the example, seven coloured filters 85 are provided, which are configured to color the light beam passing through them according to the sequence of the colors of the rainbow: red, orange, yellow, green, blue, indigo, and violet.

The rainbow device 28 can be moved so as to intercept the light beam only when needed. In particular, the rainbow device 28 is coupled to the support plate 44 by a moving mechanism (non shown in the accompanying drawings), which moves the rainbow device 28 from a position in which the device does not intercept the light beam to a position in which at least one coloured filter 85 intercepts the light beam.

When the rainbow device 28 is arranged so as to intercept the light beam and rotates, the projected beam is coloured. The rotational speed of the rainbow device 28 determines an optical effect such that the observer perceives different light beams in sequence with different colors.

According to a variant, which is not shown, fourteen coloured filters are provided, which comprise two sets of seven filters each, having the colors of the rainbow: red, orange, yellow, green, blue, indigo, and violet.

With reference to FIG. 1, the light beam processing device 7 comprise, as already mentioned above, a second gobos device 29, a frost group 30 and a prismatic element 31.

The second gobos device 29 is configured to shape the light beam passing through it. In particular, the second gobos device 29 comprises a plate, which is provided with a plurality of gobos elements (not shown in the accompanying drawings), each of them being able to rotate independently of one another.

The second gobos device 29 can be moved so as to intercept the light beam only when needed. As a matter of fact, the second gobos device 29 is provided with moving means (not shown in the accompanying drawings), which are able to selectively place at least one gobos element of the second gobos device 29 along the optical axis B.

The frost assembly 30 is configured to cause the incoming light beam to become diffused and comprises at least one optical element 86 that can be moved so as to intercept the light beam only when needed. As a matter of fact, the optical element 86 is provided with moving means (not shown in the accompanying drawings), which are able to selectively place the optical element 82 along the optical axis B. The optical element 86 is preferably defined by an acid-etched glass.

The prismatic element 31, as well, is provided with moving means (not shown), which are able to selectively place the prismatic element 31 along the optical axis B to intercept the light beam.

In particular, the prismatic element 31 is shaped so as to have face that allows the light beam streaming out of the prismatic element 31 itself to be divided into different components. In particular, the prismatic element 31 is configured to multiply the light beam into a number of different light beams based on the number of faces that define the prismatic element 31.

According to an embodiment not illustrated of the stage light fixture of the present invention, the rainbow device is replaced by a graphic/animation wheel, configured to rotate about an axis of rotation and to intercept the light beam during the rotation. In particular, the animation wheel comprises at least one graphically worked annular portion which intercepts the light beam during rotation and leads to a particular animated effect on the projected beam.

Figure 8A:
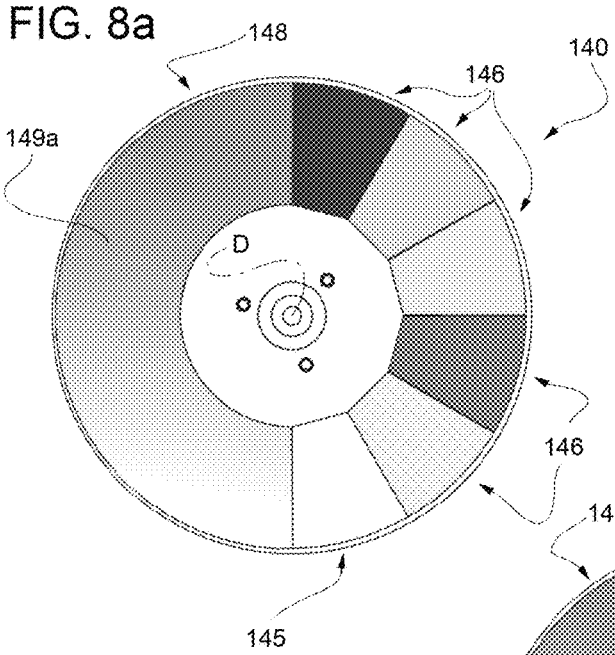
FIGS. 8*a*, 8*b* and 8*c* are front views, with parts removed for greater clarity, of details of the stage light fixture according to a further embodiment.
Figure 8B:
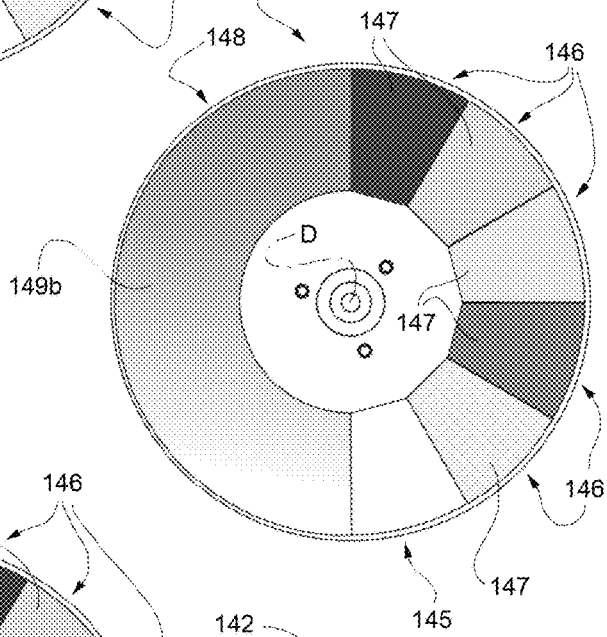
Figure 8C:
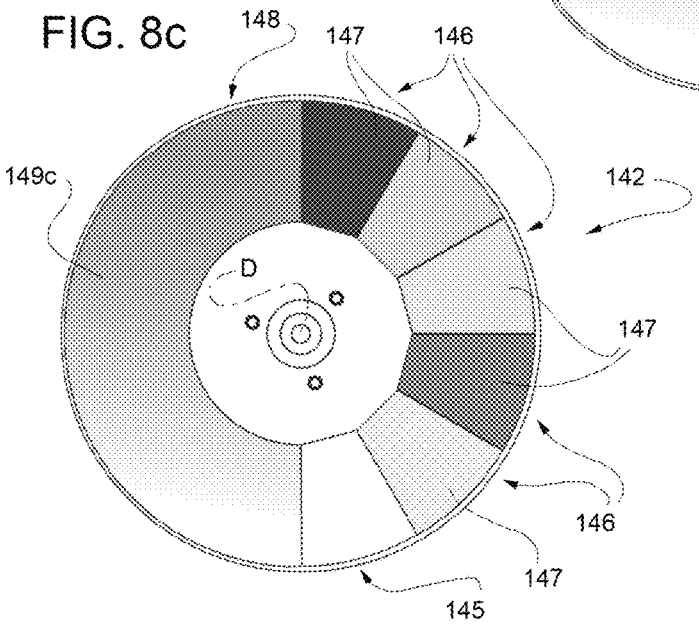

In FIGS. 8*a* 8*b* and 8*c* different embodiments of color devices 140, 141, and 142 are illustrated.

Color devices 140, 141 and 142 are similar to the color devices 40, 41 and 42 as they rotate about the same axis of rotation D and are rotated by similar moving means.

In other words, color devices 140, 141 and 142 differ from color devices 40, 41 and 42 essentially for the presence of a different combination of beam processing elements, preferably of a different combination of filters.

In particular each color devices 140, 141 and 142 according to the new embodiment comprises one trapezoidal section 145 which is not associated with any filter and does not determine any variation of the light passing through it, a plurality of trapezoidal sections 146 coupled to respective filters 147 and at least one annulus portion 148 which is coupled to a respective portion of an annular filter 149.

The trapezoidal sections 145 and 146 and the annulus portion are arranged along an annular peripheral path.

The filters 147 are similar to the ones described for the embodiment of FIGS. 1-7 and are selected in the group comprising: color filters configured to transmit light radiations having wavelengths comprised in one respective transmission band, diffusing filters configured to diffuse the passing-through light beam, hot filters configured to decrease the color temperature of the passing-through light beam, cold filters configured to increase the color temperature of the passing-through light beam, and Wood filter.

The portion of the annular filter 149 is configured to create an evanescence/fading effect during the rotation of the respective color device 140, 141, 142.

In particular, the portion of the annular filter 149 is configured to determine a progressive color change in the beam passing through it during the rotation of the respective color device 140, 141, 142.

Substantially, the portion of the annular filter 149 has the same effect of the plurality of color filters 46*b*, 56*b* and 66*b* consecutively arranged in each of the color device 40, 41, and 42.

In essence, in this new embodiment a single filter is used instead of a plurality of filters consecutively arranged.

In the non limiting example here disclosed, color device 140 comprise a portion of an annular filter 149*a* able to create a progression of cyan color, color device 141 comprise a portion of an annular filter 149*b* able to create a progression of magenta color, while color device 142 comprise a portion of an annular filter 149*c* able to create a progression of yellow color.

Analogously to what disclosed for the embodiment of FIG. 1-7, thanks to the particular structure of the portion of the annular filter 149*a*, during the rotation of the color device 140 about its own rotational axis D, one can gradually change the coloring of the projected light beam from a lighter cyan to a darker cyan or vice versa according to the direction of rotation of the first color device 140.

Thanks to the particular structure of the portion of the annular filter 149*b*, during the rotation of the color device 141 about its own rotational axis D, one can gradually change the coloring of the projected light beam from a lighter magenta to a darker magenta or vice versa according to the direction of rotation of the color device 141.

Finally thanks to the particular structure of the portion of the annular filter 149*c*, during the rotation of the color device 142 about its own rotational axis D, one can gradually change the coloring of the projected light beam from a lighter yellow to a darker yellow or vice versa according to the direction of rotation of the color device 142.

Preferably, the portion of annular filters 149*a*, 149*b* and 149*c* are obtained by removal of layers of dielectric material deposited on a glass substrate. Preferably, the layers removal is obtained using a laser technique.

Thanks to the integration of different filters in one single color device, with the stage light fixture according to the present invention it is possible to obtain a plurality of lighting effects and at the same time to reduce at the minimum the dimensions and the weight of the stage light fixture itself.

Light fixtures of the prior art, in fact, are able to obtain the same lighting effects using more devices than the ones used in the present invention.

Finally, it is clear that the stage light fixture described herein can be subject to changes and variations, without for this reason going beyond the scope of protection of the appended claims.

The invention claimed is:

1. Stage light fixture comprising:

a short arc lamp adapted to emit a light beam along an optical axis;

a reflector associated to the short arc lamp so as to concentrate light beam rays substantially at a work point;

an output optical assembly, arranged at the most downstream point along the optical axis, having a focal point arranged between the short arc lamp and the output optical assembly and coinciding with the work point;

at least one color assembly comprising a plurality of color discs configured to selectively color the light beam; the color assembly being arranged between the short arc lamp and the work point, wherein each color disc is rotatable about a same rotational axis;

wherein each color disc of the plurality of color discs comprises at least one first filter and at least one second filter, the first filter being a color filter configured to transmit light radiation having wavelengths comprised in at least one first respective band;

wherein the at least one second filter is selected in the group comprising:

a hot filter, configured to reduce the color temperature of the passing-through light beam, a cold filter configured to increase the color temperature of the passing-through light beam, a wood filter, and diffusing filter, configured to diffuse the passing-through light beam.

2. Stage light fixture according to claim 1, wherein the color discs are parallel.

3. Stage light fixture according to claim 1, wherein at least one color disc is transversal to the optical axis so as to form a first angle with a plane perpendicular to the optical axis.

4. Stage light fixture according to claim 3, wherein the first angle is a dihedral angle that is between 6° and 10°.

5. Stage light fixture according to claim 1, wherein the color discs are independently moved.

6. Stage light fixture according to claim 1, wherein rotational axis is inclined with respect to the optical axis of a second angle that is between 6° and 10°.

7. Stage light fixture according to claim 1, wherein the color assembly is arranged so as, in use, at least one portion of each color disc intersects the optical axis.

8. Stage light fixture according to claim 1, wherein the first filter is configured to create a progressive change of color in the beam passing through it during the rotation of the respective color disc.

9. Stage light fixture according to claim 8, wherein the first filter is at least a portion of an annular filter.

10. Stage light fixture according to claim 1, comprising a plurality of first filters arranged in succession along an annular path and configured to transmit respective light radiations so as to create a progressive change of color in the beam passing through them during the rotation of the respective color device.

11. Stage light fixture according to claim 1, comprising at least one dimmer arranged between the short arc lamp and the color assembly.

12. Stage light fixture according to claim 1, comprising at least one heat-shield filter arranged between the short arc lamp and the color assembly.

13. Stage light fixture according to claim 12, wherein the heat-shield filter is transversal to the optical axis so as to form a third angle with a plane perpendicular to the optical axis, the third angle being between 6° and 10°.

14. Stage light fixture according to claim 12, wherein the heat-shield filter is arranged along a plane which intersects a plane comprising at least one color disc device, so as to form a fourth angle, the fourth angle being between 12° and 20°.

15. Stage light fixture according to claim 1, comprising at least one gobos device arranged at the work point.

16. Stage light fixture comprising:

a short arc lamp adapted to emit a light beam along an optical axis;

a reflector associated to the short arc lamp so as to concentrate light beam rays substantially at a work point;

an output optical assembly, arranged at the most downstream point along the optical axis, having a focal point arranged between the short arc lamp and the output optical assembly and coinciding with the work point;

at least one color assembly comprising at least a first color disc and a second color disc each of which is configured to selectively color the light beam; the color assembly being arranged between the short arc lamp and the work point;

wherein the first color disc comprises a plurality of discrete first filters and at least two second filters, each first filter being a color filter configured to transmit light radiation having wavelengths comprised in at least one first respective band;

wherein the at least two second filters are different types of filters relative to one another and are selected from the group comprising:

a hot filter, configured to reduce the color temperature of the passing-through light beam, a cold filter configured to increase the color temperature of the passing-through light beam, a wood filter, and a diffusing filter, configured to diffuse the passing-through light beam;

wherein the plurality of discrete first filters are configured to create a progressive change of color in the beam passing through it during the rotation of the respective color disc; and wherein the second color disc comprises a plurality of color filters and at least one second filter.

17. Stage light fixture according to claim 16, wherein a number of first filters in the first color disc is different than a number of first filters in the second color disc.

18. Stage light fixture according to claim 16, wherein the first color disc and the second color disc are rotatable about a same rotational axis.

* * * * *